US007831174B2

(12) United States Patent
Nishiyama

(10) Patent No.: US 7,831,174 B2
(45) Date of Patent: Nov. 9, 2010

(54) ROTARY DEVELOPER AND IMAGE FORMATION APPARATUS HAVING ROTARY DEVELOPER

(75) Inventor: Kazuhiro Nishiyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 558 days.

(21) Appl. No.: 11/858,808

(22) Filed: Sep. 20, 2007

(65) Prior Publication Data

US 2008/0069593 A1 Mar. 20, 2008

(30) Foreign Application Priority Data

Sep. 20, 2006 (JP) ..... 2006-254384

(51) Int. Cl.
*G03G 15/04* (2006.01)
*G03G 21/00* (2006.01)

(52) U.S. Cl. ..... 399/119; 399/227

(58) Field of Classification Search ..... 399/227
See application file for complete search history.

(56) References Cited

U.S. PATENT DOCUMENTS

2005/0013632 A1* 1/2005 Kishigami ..... 399/227

FOREIGN PATENT DOCUMENTS

JP 08-328448 12/1996
JP 10-153911 6/1998
JP 2006-308695 11/2006
JP 2006-308696 11/2006

* cited by examiner

*Primary Examiner*—David P Porta
*Assistant Examiner*—Carolyn Igyarto
(74) *Attorney, Agent, or Firm*—DLA Piper LLP (US)

(57) ABSTRACT

A rotary developer for an image forming apparatus. Development cartridges accommodated in a rotary unit at a predetermined set position are selectively moved between development and non-development positions. A self-attachment locking mechanism including a pre-pressure applying mechanism self-locks a development cartridge at the predetermined set position when the development cartridge is inserted by a predetermined insertion amount that does not reach the predetermined set position. The pre-pressure applying mechanism includes a pressing member on one of the rotary unit and development cartridge and a pressed member on the other of the rotary unit and development cartridge. The pressed member includes gently sloped and steeply sloped surfaces. When the development cartridge is inserted by the predetermined insertion amount, the pressing portion transitions from contact with the gently sloped surface to contact with the steeply sloped surface.

4 Claims, 7 Drawing Sheets

ROTARY DEVELOPER AND IMAGE FORMATION APPARATUS HAVING ROTARY DEVELOPER

BACKGROUND

1. Technical Field

The present invention generally relates to a rotary developer and an image formation apparatus that is provided with the rotary developer. The rotary developer to which the invention is directed performs development by turning a rotary unit so as to set each of development cartridges at a predetermined development position in a sequential manner after the development cartridges having a plurality of colors are attached to the rotary unit. The image formation apparatus having the rotary developer according to the invention includes electrophotographic apparatuses such as an electrostatic process copying machine, an electro-photographic printer, an electrophotographic facsimile, just to name but a few with no intention of limitation thereto.

2. Related Art

Generally speaking, a full-color image formation apparatus having a rotary developer is provided with a rotary unit to which four-ink-color development cartridges are attached. A typical example thereof is disclosed in JP-A-10-153911. In the configuration of such a rotary developer, each of the development cartridges is inserted into the rotary unit from the insertion side thereof along a direction parallel to the rotation axis thereof so as to fix it at a predetermined "set" position. In the operation of such a rotary developer, when one development cartridge that is the current target of development is set at a predetermined development position by means of the rotational movement of the rotary unit, it is necessary to align the position thereof with a photosensitive member, which is an image carrier, with a high positional accuracy. In addition, it is further necessary to hold the development cartridges securely so that they cannot move undesirably in the axial direction of the rotary unit during its rotation, or due to any other similar reason.

According to the configuration of the rotary developer described in JP-A-10-153911, the development cartridges are simply attached at the predetermined set positions of the rotary unit. Therefore, it is difficult to effectively prevent the development cartridges from moving in the axial direction thereof during the rotation of the rotary unit. Moreover, a user might fail to securely attach the development cartridges at the predetermined set positions of the rotary unit.

SUMMARY

An advantage of some aspects of the invention is to provide a rotary developer that makes it possible to securely attach the development cartridges at the predetermined set positions of the rotary unit, and thereby to effectively avoid the undesirable movement of the attached development cartridges in the axial direction of the rotary unit during its rotation. A further advantage of the above-mentioned some aspects of the invention is to provide an image formation apparatus that is provided with the rotary developer having the distinctive features described above.

In order to address the above-identified problem without any limitation thereto, a rotary developer and an image formation apparatus according an aspect of the invention is provided with a development cartridge self-attachment-locking mechanism. With the configuration of the rotary developer and the image formation apparatus according to the above-mentioned aspect of the invention, thanks to the self-attachment-locking mechanism, each of development cartridges is automatically and thus easily attached at a predetermined set position of a rotary unit just by inserting it therein by a predetermined insertion amount, which is insufficient for causing the development cartridges to reach the above-mentioned predetermined set position. In addition thereto, each of the development cartridges is automatically and thus easily self-locked at the above-mentioned predetermined set position of the rotary unit just by doing the same.

Therefore, even if a user inadvertently fails to insert the development cartridges properly, which means that the depth of the inserted development cartridges falls short of the predetermined set position in the rotary unit, it is still possible to attach and lock the development cartridges at the above-mentioned predetermined set position without fault. In such a self-locking operation, the self-attachment-locking mechanism ensures that each of the development cartridges is locked both in the insertion/removal direction and the direction orthogonal to the insertion/removal direction thereof.

Since each of the development cartridges is locked in the insertion/removal direction thereof securely, it is possible to prevent any "slip out" (i.e., unintended removal/detachment) and undesirable shake/rattle thereof in a reliable manner. Thus, it is possible to securely attach the development cartridges at the predetermined set positions of the rotary unit, and thereby to effectively avoid the undesirable movement of the attached development cartridges in the axial direction of the rotary unit during its rotation.

In the configuration of the rotary developer and the image formation apparatus according the above-mentioned aspect of the invention, it is preferable that the self-attachment-locking mechanism is constituted by a pre-pressure applying mechanism that applies pre-pressure onto the development cartridge attached at the predetermined set position toward an image carrier. Since the pre-pressure applying mechanism serves a double purpose as constituent elements of the self-attachment-locking mechanism, it is possible to avoid an increase in parts count (i.e., the number of parts) and thus it is further possible to reduce cost.

In the configuration of the rotary developer and the image formation apparatus according the above-mentioned aspect of the invention, it is preferable that the pre-pressure applying mechanism is made up of a pressing member (pressing mechanical part) and a pressed member (pressed mechanical part). In addition, in the above configuration, it is further preferable that the pressed surface of the pressed member has a gently sloped pressed surface having a relatively small inclination and a steeply sloped pressed surface having a relatively large inclination in comparison with that of the gently sloped pressed surface, the gently sloped pressed surface becoming in contact with the pressing portion of the pressing member earlier than any other surface at the time of insertion of the development cartridge in the axial direction, and after becoming in contact therewith, the gently sloped pressed surface causing the lever to rotate in a direction that is against the urging force of the urging unit as the development cartridge is inserted, the steeply sloped pressed surface extending from the gently sloped pressed surface, the inclination of the steeply sloped pressed surface being opposite to that of the gently sloped pressed surface, the gently sloped pressed surface and the steeply sloped pressed surface forming an asymmetrical boomerang shape. Moreover, in the above configuration, it is further preferable that the above-mentioned predetermined insertion amount of the development cartridge is set at an amount that causes a transition of a contact position at which the pressing portion is in contact with the pressed surface from the gently sloped pressed surface to the steeply sloped pressed surface.

With such a configuration, it is possible to attach and lock the development cartridges at the predetermined set position in a reliable manner while simplifying the structure of the self-attachment-locking mechanism and further simplifying the attachment operation of the development cartridges.

In the configuration of the rotary developer and the image formation apparatus according the above-mentioned aspect of the invention, it is preferable that, when the development cartridge is set at the non-development position, the pressing portion is in contact with the steeply sloped pressed surface and the level pressed surface at two contact points/positions. Therefore, it is possible to lock the development cartridge that is attached at the predetermined set position both in the insertion/removal direction and the direction orthogonal to the insertion/removal direction thereof just with a simple structure. By this means, it is possible to prevent any unintended removal/detachment of the development cartridges during rotation of the rotary unit.

In addition, the integrated pressed surface where the pressing portion contacts is constituted by the gently sloped pressed surface and the steeply sloped pressed surface having, just for the purpose of descriptive and illustrative explanation, an asymmetrical boomerang shape. Therefore, a force that is exerted during the insertion of the development cartridge, that is, the axial direction component of the pressing force applied by the pressing portion onto the gently sloped pressed surface/the steeply sloped pressed surface, reverses its direction suddenly when the contact position/point between the pressing portion and the pressed surface transitions from the gently sloped pressed surface to the steeply sloped pressed surface. Since such a sudden reverse in the direction of the force provides a user with a tactile feel at the instant of the transition, the user can perceive the activation/initiation of the automatic insertion function/operation performed by the self-attachment-locking mechanism of the development cartridge on the basis of the tactile feel.

When the development cartridge is set at the development position, the pressing surface of the pressing portion is in contact with the level pressed surface at only one contact point. However, since both of the development driving gear and the development input gear are configured as helical gears, the helical-gear configuration provides a momentum to the development cartridge along the axial direction, that is, in the insertion direction thereof when the development cartridge is driven at the development position thereof. Therefore, even when the development cartridge is set at the development position so that the pressing portion is in contact with the level pressed surface at only one contact point, it is still possible to lock the development cartridge that is carried from the attached set position both in the insertion/removal direction and the direction orthogonal to the insertion/removal direction thereof just with a simple structure.

In the configuration of the rotary developer and the image formation apparatus according the above-mentioned aspect of the invention, it is preferable that, if the user turns a cover, which is provided on the apparatus body in a rotatable manner, clockwise in order to close the opening, although the development cartridge is not inserted sufficiently, meaning that the depth of insertion falls short of the predetermined insertion amount, the pushing projection provided on the cover pushes the development cartridge inserted in the rotary unit toward the set position as the cover is closed. Because the maximum push depth at which the pushing projection pushes the development cartridge to the deepest position thereof is set at the predetermined amount of insertion of the development cartridge obtained when the cover closes the opening, it is possible to activate the self-attachment-locking mechanism so as to automatically attach the development cartridge at the predetermined set position and self-lock the development cartridge at the predetermined set position in a reliable manner, which is achieved just by closing the rotatable cover.

BRIEF DESCRIPTION OF THE DRAWINGS

The invention will be described with reference to the accompanying drawings, wherein like numbers reference like elements.

FIG. 2A is a perspective view that schematically illustrates an example of a rotary unit, whereas

FIG. 4A is a front view that schematically illustrates an example of a development cartridge that is attached to the rotary unit, whereas

DESCRIPTION OF EXEMPLARY EMBODIMENTS

Figure 1:
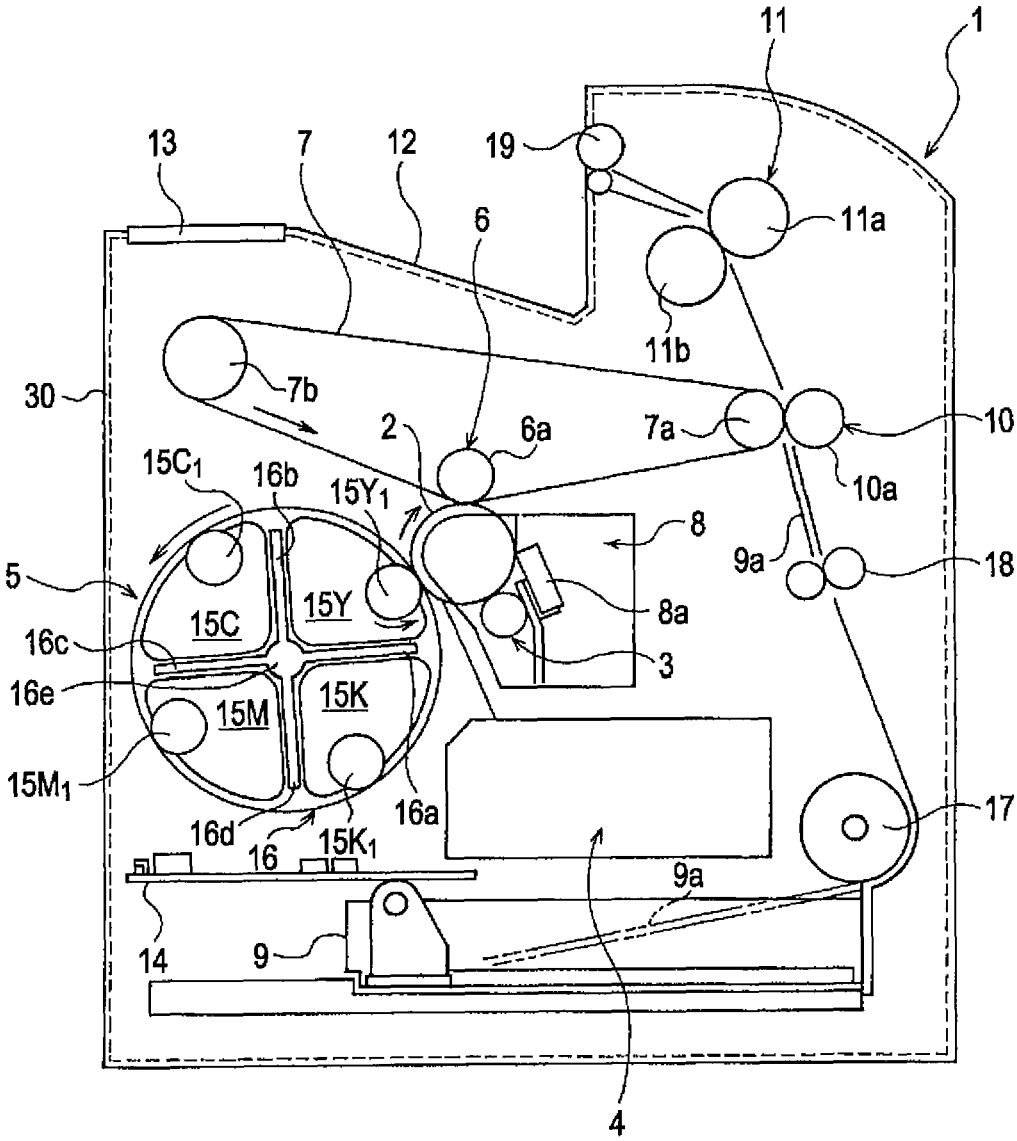
FIG. 1 is a diagram that schematically illustrates an example of an image formation apparatus that is provided with a rotary developer according to an exemplary embodiment of the invention.
Figure 2A:
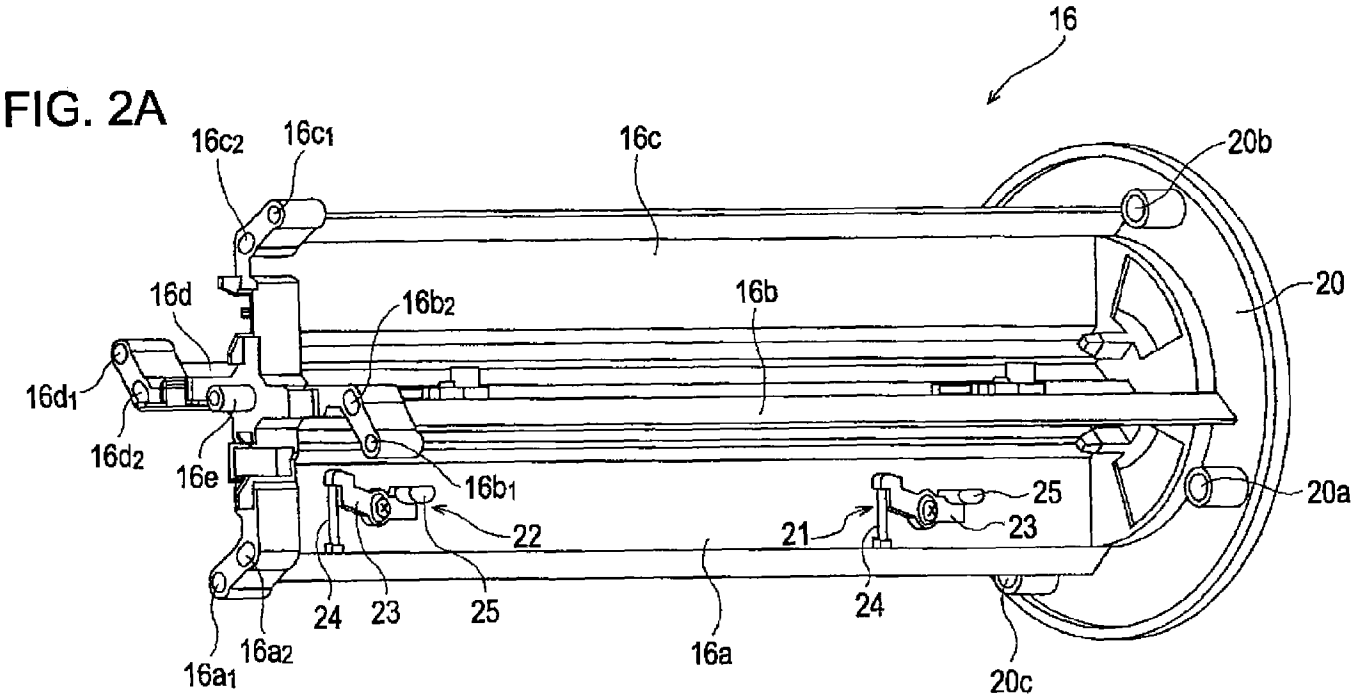
Figure 2B:
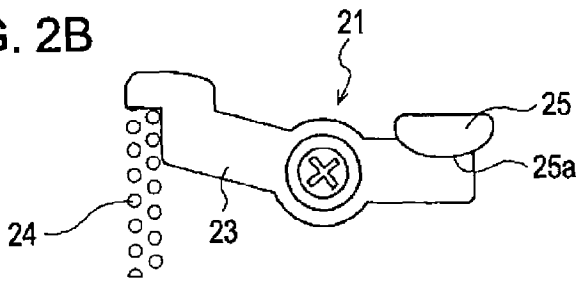
FIG. 2B is a diagram that schematically illustrates an example of a pressing mechanical part.

With reference to accompanying drawings, exemplary embodiments of the invention is explained below. FIG. 1 is a diagram that schematically illustrates an example of an image formation apparatus that is provided with a rotary developer according to an exemplary embodiment of the invention. FIG. 2A is a perspective view that schematically illustrates an example of a rotary unit. FIG. 2B is a diagram that schematically illustrates an example of a pre-pressure applying mechanism.

As illustrated in FIG. 1, an image formation apparatus 1 according to the present embodiment of the invention is configured as a full-color printer. The image formation apparatus 1 is provided with a photosensitive member 2, which is an image carrier that is able to carry an electrostatic latent image and a toner image. The photosensitive member 2, which is a known photoconductor/photoreceptor, has a cylindrical conductive base substrate and a photosensitive layer formed on the outer circumference of the cylindrical conductive base substrate. Note that these base substrate and layer are omitted from the drawing. An electrostatic latent image and a toner image are formed on the photosensitive layer of the photosensitive member 2. The photosensitive member 2 can rotate clockwise around its turn axis during operation, that is, in the direction shown by an arrow in FIG. 1.

An electrostatic charging unit 3, a light exposure unit 4, a rotary developer (i.e., rotary developing unit) 5, a primary image-transfer unit 6, an intermediary image-transfer unit 7, and a cleaning unit 8 are provided around the photosensitive member 2. Specifically, these components are arranged in the order of appearance herein toward the downward region of the photosensitive member 2, which is viewed along the rotational direction thereof. The image formation apparatus 1 is further provided with a paper feed tray 9, a secondary image-transfer unit 10, an image fixation unit 11, a paper eject tray 12, a display unit 13, and a control unit 14.

The electrostatic charging unit 3 is a known electrification device that electrifies the photosensitive member 2 in a uniform manner. The light exposure unit 4 is a device that forms a latent image on the electrified photosensitive member 2 by irradiating a beam of laser thereon. The rotary developer 5 is provided with a yellow development cartridge 15Y, a cyan development cartridge 15C, a magenta development cartridge 15M, and a black development cartridge 15K. The yellow development cartridge 15Y is a yellow (Y) development container, whereas the cyan development cartridge 15C, the magenta development cartridge 15M, and the black development cartridge 15K are a cyan (C) development container, a magenta (M) development container, and a black (K) development container, respectively. Each of the yellow development cartridge 15Y, the cyan development cartridge 15C, the magenta development cartridge 15M, and the black development cartridge 15K is used as a developer when forming a color toner image on the photosensitive member 2. Specifically, an electrostatic latent image for each color component formed on the photosensitive member 2 is developed by means of a toner of the corresponding color, which serves as a photographic developer.

The rotary developer 5 has a rotary unit 16. The rotary unit 16 is configured to be able to rotate counterclockwise, that is, in the direction opposite to the rotational direction of the photosensitive member 2. As illustrated in FIGS. 1 and 2A, the rotary unit 16 has four attachment frames 16*a*, 16*b*, 16*c*, and 16*d* to which the development cartridges 15Y, 15C, 15M, and 15K are detachably attached. These attachment frames 16*a*, 16*b*, 16*c*, and 16*d* are provided with an equal interval each between adjacent ones thereof with the turn (i.e., rotation) axis of the rotary unit 16 being at their center, that is, with each 90-degree interval therebetween. Each of these attachment frames 16*a*, 16*b*, 16*c*, and 16*d* extends in a direction parallel to the turn axis of the rotary unit 16. Each of these attachment frames 16*a*, 16*b*, 16*c*, and 16*d* is fixed to the rotational axis 16*e* of the rotary unit 16 to constitute a single integrated structure. When viewed in a cross-sectional angle, these attachment frames 16*a*, 16*b*, 16*c*, and 16*d* and the rotational axis 16*e* constitute a substantially cruciform structure.

Each of the development cartridges 15Y, 15C, 15M, and 15K is inserted in the direction parallel to the rotation axis 16*e* between a corresponding pair of two attachment frames among the attachment frames 16*a*, 16*b*, 16*c*, and 16*d* so as to be fixed at its set position. In an exemplary illustration of FIG. 1, for example, the yellow development cartridge 15Y is attached at its set position between the corresponding pair of the attachment frames 16*a* and 16*b*. The same applies for other development cartridges.

Each one of the yellow development cartridge 15Y, the cyan development cartridge 15C, the magenta development cartridge 15M, and the black development cartridge 15K has the same fundamental configuration as those of others. Therefore, in the following description, the structure of the yellow development cartridge 15Y is explained while omitting any redundant explanation for the remaining development cartridges 15C, 15M, and 15K.

Figure 3:
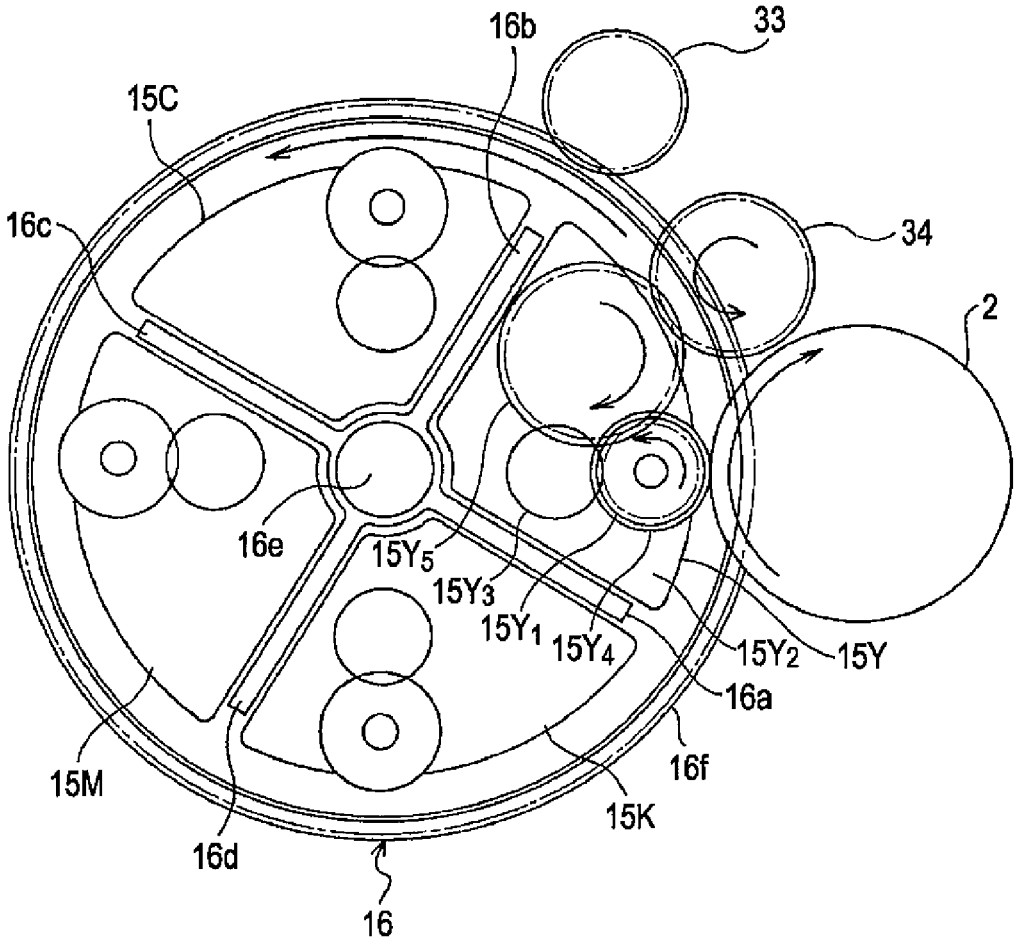
FIG. 3 is an enlarged view that schematically illustrates the rotary developer illustrated in FIG. 1, which shown together with a photosensitive member.

The yellow development cartridge 15Y is configured as a cylindrical container that is elongated along the axial direction. Both ends of the cylindrical yellow development cartridge 15Y are closed. As illustrated in FIG. 3, the yellow development cartridge 15Y is provided with a yellow development roller $\mathbf{15Y_1}$, a yellow toner containing portion $\mathbf{15Y_2}$, and a yellow supply roller $\mathbf{15Y_3}$. The yellow development roller $\mathbf{15Y_1}$ transports yellow toner to the photosensitive member 2. The yellow toner containing portion $\mathbf{15Y_2}$ contains the yellow toner. The yellow supply roller $\mathbf{15Y_3}$ supplies the yellow toner retained in the yellow toner containing portion $\mathbf{15Y_2}$ to the yellow development roller $\mathbf{15Y_1}$. Though not shown in the drawing, the yellow development cartridge 15Y is further provided with a yellow layer-thickness-adjustment member, which functions to keep the proper layer thickness of the yellow toner on the yellow development roller $\mathbf{15Y_1}$.

A pair of gap-forming rollers $\mathbf{15Y_4}$ that have the same dimension with each other is provided on the rotation axis of the yellow development roller $\mathbf{15Y_1}$. These gap-forming rollers $\mathbf{15Y_4}$ are provided at positions that are slightly displaced from the respective ends of the yellow development roller $\mathbf{15Y_1}$. With such a configuration, the gap-forming rollers $\mathbf{15Y_4}$ and the yellow development roller $\mathbf{15Y_1}$ are able to rotate as a single integrated mechanical unit. The diameter of each of the gap-forming rollers $\mathbf{15Y_4}$ is configured to be slightly larger than that of the yellow development roller $\mathbf{15Y_1}$. Accordingly, when the yellow development cartridge 15Y is set at the development position illustrated in FIG. 3, the pair of the gap-forming rollers $\mathbf{15Y_4}$ contact the photosensitive member 2 so as to form a predetermined gap between the yellow development roller $\mathbf{15Y_1}$ and the photosensitive member 2. By this means, the yellow development roller $\mathbf{15Y_1}$ performs development on an electrostatic latent image formed on the photosensitive member 2 in a non-contact state.

As illustrated in FIG. 3, the rotary unit 16 has a rotary input gear 16*f* having a relatively large diameter. A rotary driving gear 33 is provided on an apparatus body 30 in a rotatable manner. The rotary driving gear 33 engages with the rotary input gear 16f. The rotary driving gear 33 is configured to rotate the rotary input gear 16*f* when a motive power (i.e., driving force) is communicated (i.e., transmitted) to the rotary driving gear 33 from driving means such as a motor or the like that is not shown in the drawing.

The yellow development cartridge 15Y is further provided with a development input gear $\mathbf{15Y_5}$. A development driving gear 34 is provided on the apparatus body 30 in a rotatable manner. The development driving gear 34 engages with the development input gear $\mathbf{15Y_5}$. Both of the development input gear $\mathbf{15Y_5}$ and the development driving gear 34 are configured as helical gears. The development driving gear 34 is configured to rotate the yellow development roller 15Y, and the yellow supply roller $\mathbf{15Y_3}$ via the development input gear $\mathbf{15Y_5}$ when a motive power is communicated to the development driving gear 34 from driving means such as a motor or the like that is not shown in the drawing. During an operation time period in which the development driving gear 34 rotates the development input gear $\mathbf{15Y_5}$, the helical-gear configuration of the development driving gear 34 and the development input gear $\mathbf{15Y_5}$ provides a momentum to the yellow development cartridge 15Y along the axial direction, or more specifically, in the insertion direction of the yellow development cartridge 15Y. The characteristic configuration of the rotary developer 5 according to the present embodiment of the invention, which constitutes distinctive features different from those of conventional rotary developers, will be described in detail later.

In the same manner as a known primary image-transfer unit does, the primary image-transfer unit 6 according to the present embodiment of the invention transfers a toner image formed on the photosensitive member 2 to the intermediary image-transfer unit 7 as the first-step image transfer by means of a primary image-transfer roller 6*a* thereof. The intermediary image-transfer unit 7 is configured as an intermediary image-transfer belt that is made of a known endless belt. The intermediary image-transfer belt 7 is wound around a driving roller 7*a* and a driven roller (i.e., slave roller) 7*b* so as to be turned counterclockwise as shown in FIG. 1.

As is the case with a conventional cleaning unit, the cleaning unit 8 according to the present embodiment of the invention has, for example, a rubber cleaning blade 8*a* that is provided between the primary image-transfer unit 6 and the electrostatic charging unit 3. Through the contact of the cleaning blade 8*a* on the photosensitive member 2, the cleaning unit 8 collects any remaining toner T from the surface of the photosensitive member 2 after completion of the primary image transfer. The paper feed tray 9 accommodates (and feeds) an image-transfer target material 9*a* such as paper or the like.

In the same manner as a known secondary image-transfer unit does, as the second-step image transfer, the secondary image-transfer unit 10 according to the present embodiment of the invention transfers the toner image which has been transferred on the intermediary image-transfer unit 7 to the image-transfer target material 9*a* such as paper or the like by means of a secondary image-transfer roller 10*a* thereof. In the same manner as a known image fixation unit does, the image fixation unit 11 according to the present embodiment of the invention melts the toner image transferred to the image-transfer target material 9*a* such as paper or the like and fixes the melted toner image thereon so as to form a photographically fixed image by means of a heating roller 11*a* and a pressure-applying roller 11*b* thereof.

The paper eject tray 12 receives the image-transfer target material 9*a* on which the photographically fixed image is formed. A known display device such as a liquid display panel or the like constitutes the display unit 13. The display unit 13 shows operation keys to be manipulated by a user. The display unit 13 further shows the setting status of the image formation apparatus 1. The control unit 14 communicates with a personal computer that is provided as an external device. Through such communication, the control unit 14 controls each unit/component of the image formation apparatus 1 so as to form images.

Next, the operation of the image formation apparatus 1 according to the present embodiment of the invention is explained below. When image data and a control signal is inputted from an external personal computer to the control unit 14 of the image formation apparatus 1, the control unit 14 activates the image formation apparatus 1. This initiates the image-formation operation of the image formation apparatus 1. In this initial state, the photosensitive member 2 is in contact with the intermediary image-transfer unit 7, whereas the secondary image-transfer roller 10*a* of the secondary image-transfer unit 10 is not in contact with the intermediary image-transfer unit 7. In addition, in this initial state, the rotary unit 16 sets the yellow development cartridge 15Y selectively at the development position as illustrated in FIGS. 1 and 3. This means that the pair of the gap-forming rollers $\mathbf{15}Y_4$ of the yellow development cartridge 15Y is in contact with the photosensitive member 2. Moreover, the rotary driving gear 33 is in engagement with the rotary input gear 16*f* whereas the development driving gear 34 is in engagement with the development input gear $\mathbf{15}Y_5$ in this state.

After the start of the image formation operation of the image formation apparatus 1, the photosensitive member 2 rotates to be electrified by the electrostatic charging unit 3. Next, the electrification region of the photosensitive member 2 is subjected to light exposure by the light exposure unit 4. Through the light exposure thereof, an electrostatic latent image of the first color is formed. In this exemplary embodiment of the invention illustrated in FIG. 1, a yellow (Y) electrostatic latent image is formed as the first color. Subsequently, the development driving gear 34 rotates the development input gear $\mathbf{15}Y_5$ so as to develop the yellow (Y) electrostatic latent image formed on the photosensitive member 2 by means of the yellow toner of the yellow development cartridge 15Y. By this means, a yellow (Y) toner image is formed on the photosensitive member 2.

Then, the primary image-transfer unit 6 transfers the yellow toner image formed on the photosensitive member 2 to the intermediary image-transfer unit 7. The cleaning blade 8*a* of the cleaning unit 8 collects any remaining yellow toner from the surface of the photosensitive member 2 after completion of the primary transfer of the yellow toner image. While the cleaning blade 8*a* of the cleaning unit 8 performs such a toner removal task, the yellow toner image transferred to the intermediary image-transfer unit 7 moves as the intermediary image-transfer unit 7 turns.

Next, the motive power of driving means such as a motor or the like that is not shown in the drawing is communicated to the rotary driving gear 33. Driven by such a motor power, the rotary driving gear 33 turns. The rotational force of the rotary driving gear 33 turns the rotary unit 16 in a counterclockwise direction by 90 degrees; and as a result thereof, the black development cartridge 15K is selectively set at the development position. When the black development cartridge 15K is set at the development position, the black development roller $\mathbf{15}K_1$ of the black development cartridge 15K (more exactly, the pair of the gap-forming rollers $\mathbf{15}K_4$ thereof) becomes in contact with the photosensitive member 2. In addition thereto, the development input gear $\mathbf{15}K_5$ becomes in engagement with the development driving gear 34. The photosensitive member 2 rotates to be electrified again by the electrostatic charging unit 3. Then, the electrification region of the photosensitive member 2 is subjected to light exposure by the light exposure unit 4. Through the light exposure thereof, an electrostatic latent image of the second color is formed. In this exemplary embodiment of the invention illustrated in FIG. 1, a black (K) electrostatic latent image is formed as the second color. Subsequently, the black (K) electrostatic latent image formed on the photosensitive member 2 is developed by means of the black toner of the black development cartridge 15K. By this means, a black (K) toner image is formed on the photosensitive member 2.

Then, the primary image-transfer unit 6 transfers the black toner image formed on the photosensitive member 2 to the intermediary image-transfer unit 7. In such a transferring operation, the black toner image is "color-superposed" on the yellow toner image formed on the intermediary image-transfer unit 7, which is now at such a position after one rotational cycle of the belt movement of the intermediary image-transfer unit 7. The cleaning blade 8*a* of the cleaning unit 8 collects any remaining black toner from the surface of the photosensitive member 2 after completion of the primary transfer of the black toner image. While the cleaning blade 8*a* of the cleaning unit 8 performs such a toner removal task, the yellow toner image and the black toner image transferred to the intermediary image-transfer unit 7 move as the intermediary image-transfer unit 7 turns.

Thereafter, the same series of operation, that is, the rotation, electrification, light exposure, development, and primary image transfer of the rotary developer 5, is carried out for the third color which is magenta (M) according to the exemplary embodiment of the invention illustrated in FIG. 4, and then for the fourth color which is cyan (C) according thereto. In this way, four colors of images, that is, the yellow toner image, the black toner image, the magenta toner image, and the cyan toner image are superposed sequentially on the intermediary image-transfer unit 7 to form a full-color toner image thereon. It should be noted that the cleaning blade 8*a* of the cleaning unit 8 collects any remaining magenta toner, and then, cyan toner from the surface of the photosensitive member 2 after completion of the primary transfer of the magenta toner image, and thereafter, the cyan toner image in the same manner of removal operation as done for the yellow toner and the black toner.

The secondary image-transfer unit 10 transfers the full-color toner image that has been formed on the intermediary image-transfer unit 7 to the image-transfer target material 9*a* by means of the secondary image-transfer roller 10*a* thereof. Prior to such a secondary image transfer operation, through the operation of a paper feed roller 17, the image-transfer target material 9*a* such as paper was picked up from the paper feed tray 9 on a sheet-by-sheet basis for transport thereof. Thereafter, the transported paper is subjected to timing control at a registration roller 18. Then, the timing-adjusted image-transfer target material 9*a* is further transported to the secondary image-transfer unit 10 at which it is subjected to the secondary image-transfer as described above. Subsequently, the image fixation unit 11 applies heat and pressure on the full-color toner image transferred to the image-transfer target material 9*a* by means of the heating roller 11*a* and the pressurizing roller 11*b* thereof. By this means, a photographically fixed image is formed on the image-transfer target material 9*a*. Finally, the image-transfer target material 9*a* having the photographically fixed full-color toner image is ejected to the paper eject tray 12 by means of a paper eject roller 19. This is how the image formation apparatus 1 according to the present embodiment of the invention carries out full-color image formation.

The image formation apparatus 1 according to the present embodiment of the invention is capable of forming not only full-color images, the formation of which is described above, but also single-color images. As an example, an explanation is given of unicolor image formation operation for black (K), that is, monochrome image formation operation.

In the monochrome image formation operation, the black development cartridge 15K of the rotary developer 5 is set at the development position to be opposed to the photosensitive member 2. In the same manner as done in the full-color image formation operation described above, electrification processing, light exposure processing, and black color (K) development processing is performed sequentially on the photosensitive member 2. As a result thereof, a black toner image is formed on the photosensitive member 2. The black toner image formed on the photosensitive member 2 is primary-transferred to the intermediary image-transfer unit 7 by the primary image-transfer unit 6. Thereafter, the black toner image on the intermediary image-transfer unit 7 is secondary-transferred to the image-transfer target material 9*a* by the secondary image-transfer unit 10. The cleaning unit 8 collects any remaining black toner from the surface of the photosensitive member 2 after completion of the primary transfer of the black toner image.

The black toner image transferred to the image-transfer target material 9*a* is subjected to photographic image fixation processing performed by the image fixation unit 11. Finally, the image-transfer target material 9*a* having the photographically fixed black toner image is ejected to the paper eject tray 12. In this way, monochrome image formation is performed.

Next, the characteristic portion of the rotary developer 5 according to the present embodiment of the invention is explained below. The rotary unit 16 according to the present embodiment of the invention is further provided with a flange-shaped disc member 20. As illustrated in FIG. 2A, the disc member 20 is fixed at one end of each of the aforementioned four attachment frames 16*a*, 16*b*, 16*c*, and 16*d* in such a manner that the plane of the disc member 20 is orthogonal to the axial direction of the rotation axis 16*e*. The disc member 20 functions to close the above-mentioned one end (right end according to FIG. 2A) of a development cartridge attachment space that is demarcated by each adjacent pair of the attachment frames 16*a*, 16*b*, 16*c*, and 16*d*. On the other hand, the other end (left end according to FIG. 2A) of the development cartridge attachment space demarcated by each adjacent pair of the attachment frames 16*a*, 16*b*, 16*c*, and 16*d* constitutes an open end. With such a structure, each of the development cartridges 15Y, 15C, 15M, and 15K is inserted from the above-mentioned other open end of the corresponding development cartridge attachment space in the axial direction. In this way, each of the development cartridges 15Y, 15C, 15M, and 15K is housed in the corresponding one of the development cartridge attachment spaces.

A pair of joint holes $\mathbf{16}a_1$, $\mathbf{16}a_2$; $\mathbf{16}b_1$, $\mathbf{16}b_2$; $\mathbf{16}c_1$, $\mathbf{16}c_2$; and $\mathbf{16}d_1$, $\mathbf{16}d_2$, which are bored in the axial direction of the rotary unit 16, is formed at the other end of each of the attachment frames 16*a*, 16*b*, 16*c*, and 16*d*. As illustrated in FIG. 2A, positional determination hole parts 20*a*, 20*b*, and 20*c* each of which is configured as a short tubular member are provided on the disc member 20. The positional determination hole parts 20*a*, 20*b*, and 20*c* correspond to the development cartridge attachment space demarcated by a pair of the attachment frames 16*a* and 16*b* adjacent to each other, the development cartridge attachment space demarcated by a pair of the attachment frames 16*b* and 16*c* adjacent to each other, and the development cartridge attachment space demarcated by a pair of the attachment frames 16*d* and 16*a* adjacent to each other, respectively. Though not shown in the drawing, the same positional determination hole part (20*d*) is provided so that it corresponds to the development cartridge attachment space demarcated by a pair of the attachment frames 16*c* and 16*d* adjacent to each other.

A pair of pressing mechanical parts 21 and 22 is provided on the attachment frame 16*a* with a predetermined axial distance left therebetween. In comparison with the pressing mechanical part 22 that is provided at the rear/proximal side viewed in the direction of insertion, the pressing mechanical part 21 provided at the front/distal side viewed in the above-mentioned direction is displaced to the right with respect to the direction of insertion. When the yellow development cartridge 15Y is attached at the predetermined set position in the development cartridge attachment space demarcated by the adjacent pair of the attachment frames 16*a* and 16*b*, these pressing mechanical parts 21 and 22 function to apply pre-pressure toward a direction in which the gap-forming rollers $\mathbf{15}Y_4$ of the yellow development cartridge 15Y are pressed to contact the photosensitive member 2. In such a configuration, when the yellow development cartridge 15Y is set at the development position, each of these pressing mechanical parts 21 and 22 presses the gap-forming rollers $\mathbf{15}Y_4$ of the yellow development cartridge 15Y toward the center of the photosensitive member 2.

The pressing mechanical part 22 has completely the same structure as that of the pressing mechanical part 21. Therefore, in the following description, the configuration of the pressing mechanical part 21 is explained while omitting any redundant explanation for the pressing mechanical part 22. As illustrated in FIG. 2B, the pressing mechanical part 21 has a lever 23 that is provided on the attachment frame 16*a* in a rotatable manner and further has a compression spring 24 that functions as means for urging the lever 23. The lever 23 has a pressing portion 25 at its one end (right end according to FIG. 2B). The lower surface of the pressing portion 25 is configured as a curved pressing surface (i.e., a surface for pressing) 25*a*, which is formed as, for example, a circular arc, an elliptic arc, or the like. The compression spring 24 is loaded (i.e., provided in a compressed state) between the other end (left end according to FIG. 2B) of the lever 23 and the attachment frame 16*a*. Therefore, the compression spring 24 urges the lever 23 constantly in a clockwise direction so that the pressing portion 25 of the lever 23 applies a downward pressing force in the FIG. 2B. It should be noted that the same reference numerals as those used for the pressing mechanical part 21 described above (23, 24, 25, and 25*a*) are consistently used to denote the lever, compression spring, pressing portion, and pressing surface of the counterpart pressing mechanical part 22.

The pressing mechanical parts 21 and 22 are also provided on the attachment frame 16*b* that is adjacent to the attachment frame 16*a*, though they are not shown in the drawing. In addition thereto, the pressing mechanical parts 21 and 22 are provided the remaining two attachment frames, too.

Figure 4A:
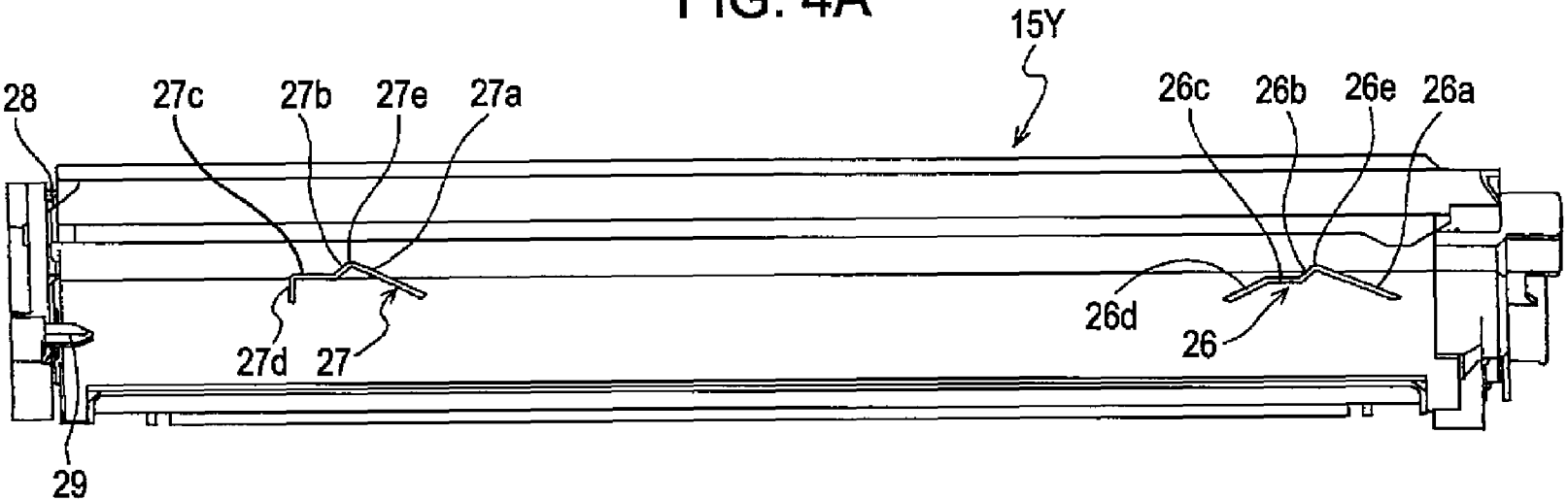

As illustrated in FIG. 4A, a pair of pressed mechanical parts (i.e., members) 26 and 27 is provided on the outer surface of the yellow development cartridge 15Y with a predetermined axial distance left therebetween. Each of the pressed mechanical parts 26 and 27 is formed as a multi-bent band plate. In comparison with the pressed mechanical part 27 that is provided at the rear/proximal side viewed in the direction of insertion of the yellow development cartridge 15Y (i.e., left side according to FIG. 4A), the pressed mechanical part 26 provided at the front/distal side viewed in the above-mentioned direction (i.e., right side according to FIG. 4A) is displaced to the right with respect to the direction of insertion thereof.

Figure 4B:
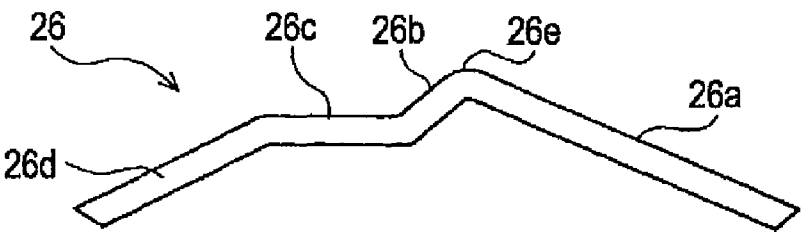
FIG. 4B is a diagram that schematically illustrates an example of a pressed mechanical part.

As illustrated in FIG. 4B, the pressed mechanical part 26 has a pressed surface (i.e., a counterpart surface to be pressed) 26*a* having a relatively gentle slope, which is slanted with a relatively small inclination; a pressed surface 26*b* having a relatively steep slope, which is slanted with a relatively large inclination; a level pressed surface 26*c* having no slope, which is not inclined; and a supporting portion 26*d*. Each of the pressed surface 26*a* having a relatively gentle slope, the pressed surface 26*b* having a relatively steep slope, and the level pressed surface 26*c* could become in contact with the pressing surface 25*a* of the pressing portion 25 of the lever 23 when the yellow development cartridge 15Y is inserted into the development cartridge attachment space demarcated by the adjacent pair of the attachment frames 16*a* and 16*b*. When the pressing surface 25*a* of the pressing portion 25 of the lever 23 is in contact with either one (or more) of the pressed surface 26*a* having a relatively gentle slope, the pressed surface 26*b* having a relatively steep slope, and the level pressed surface 26*c*, the pressing surface 25*a* applies a pressing force on the pressed surface 26*a*, 26*b*, or 26*c* that is/are currently in contact therewith by means of the decompression force of the compression spring 24, which is communicated through the lever 23.

The gently sloped pressed surface 26*a* is configured as a slanted surface having a relatively small inclination, which transitions to the left with respect to the direction of insertion of the yellow development cartridge 15Y (i.e., to the top according to FIGS. 4A and 4B) when viewed along the axial direction of insertion of the yellow development cartridge 15Y from the front/distal side thereof (i.e., right side according to FIG. 4A) toward the rear/proximal side thereof (i.e., left side according to FIG. 4A). It should be noted that the gently sloped pressed surface 26*a* is formed as a forefront portion viewed in the direction of insertion of the yellow development cartridge 15Y. Accordingly, when the yellow development cartridge 15Y is inserted into the rotary unit 16, the pressing surface 25*a* of the pressing portion 25 becomes in contact with the gently sloped pressed surface 26*a* earlier than any other pressed surfaces.

The steeply sloped pressed surface 26*b* is configured as a slanted surface having a relatively large inclination, which transitions to the right with respect to the direction of insertion of the yellow development cartridge 15Y (i.e., to the bottom according to FIGS. 4A and 4B) when viewed along the axial direction of insertion of the yellow development cartridge 15Y from the front/distal side thereof (i.e., right side according to FIG. 4A) toward the rear/proximal side thereof (i.e., left side according to FIG. 4A). In other words, the steeply sloped pressed surface 26*b* has an inclination that is opposite in the sense of polarity to that of the gently sloped pressed surface 26*a*. The steeply sloped pressed surface 26*b* extends from the gently sloped pressed surface 26*a* in such a manner that the steeply sloped pressed surface 26*b* lies immediately behind the gently sloped pressed surface 26*a* when viewed in the direction of insertion of the yellow development cartridge 15Y. An apex portion 26*e* is formed between the gently sloped pressed surface 26*a* and the steeply sloped pressed surface 26*b*. The apex portion 26*e* is configured as an R portion having a rounded angle. Having the structure described above, the gently sloped pressed surface 26*a* and the steeply sloped pressed surface 26*b* forms an integrated pressed surface having, just for the purpose of descriptive and illustrative explanation, an "asymmetrical boomerang shape" having a longer right wing (for example, refer to the drawings).

The level pressed surface 26*c* is configured as a flat surface that is parallel to the axial direction of the yellow development cartridge 15Y. The level pressed surface 26*c* extends from the steeply sloped pressed surface 26*b* in such a manner that the level pressed surface 26*c* lies immediately behind the steeply sloped pressed surface 26*b* when viewed in the direction of insertion of the yellow development cartridge 15Y. The supporting portion 26*d* has an inclination that is not opposite in the sense of polarity to that of the steeply sloped pressed surface 26*b*. In addition, the inclination of the supporting portion 26*d* is gentle in comparison with that of the steeply sloped pressed surface 26*b*. The supporting portion 26*d* supports each of the gently sloped pressed surface 26*a*, the steeply sloped pressed surface 26*b*, and the level pressed surface 26*c* when it receives a pressing force from the pressing surface 25*a*.

As illustrated in FIG. 4A, the other pressed mechanical part 27 has the gently sloped pressed surface 27*a*, the steeply sloped pressed surface 27*b*, and the level pressed surface 27*c*, which are completely the same as the gently sloped pressed surface 26*a*, the steeply sloped pressed surface 26*b*, and the level pressed surface 26*c* of the pressed mechanical part 26, respectively, except that there is a single difference in that the supporting portion 27*d* of the pressed mechanical part 27 is bent at right angles to the axial direction, which is not the case for the pressed mechanical part 26.

As illustrated in FIG. 4A, a pair of joint pins 28 and 29 projects in the axial direction at the rear/proximal end viewed in the direction of insertion of the yellow development cartridge 15Y. When the yellow development cartridge 15Y is inserted into the development cartridge attachment space demarcated by the adjacent pair of the attachment frames 16*a* and 16*b* so as to be fixed at the predetermined set position, the joint pin 28, one of the above-mentioned pair, fits into the joint hole $16b_1$ of the attachment frame 16*b*. On the other hand, when the yellow development cartridge 15Y is inserted into the development cartridge attachment space demarcated by the adjacent pair of the attachment frames 16*a* and 16*b* so as to be fixed at the predetermined set position, the joint pin 29, the other of the above-mentioned pair, fits into the joint hole $16a_2$ of the attachment frame 16*a*. These joints ensure that, when the yellow development cartridge 15Y is fixed at the predetermined set position, the yellow development cartridge 15Y is securely fastened to the rotary unit 16 in the rotational direction thereof.

Though not shown in the drawing, a positional determination pin projects in the axial direction at the front/distal end viewed in the direction of insertion of the yellow development cartridge 15Y. When the yellow development cartridge 15Y is fixed at the predetermined set position in the development cartridge attachment space demarcated by the adjacent pair of the attachment frames 16*a* and 16*b*, this positional determination pin fits into the positional determination hole part 20*a* provided on the disc member 20. This joint ensures that the yellow development cartridge 15Y is set in the prescribed position, which means proper positional determination, on the rotary unit 16 in the rotational direction thereof when the yellow development cartridge 15Y is attached at the predetermined set position.

The same reference numerals are consistently used for the components of development cartridges for other remaining colors 15C, 15M, and 15K as those of the yellow development cartridge 15Y so as to omit any redundant explanation or simplify thereof.

The image formation apparatus 1 according to the present embodiment of the invention is configured to have an attachment position that is provided to attach the development cartridge 15Y, 15C, 15M, or 15K to the rotary unit 16 or a replacement position that is provided to replace an old cartridge with a new one for each color thereon. In such a configuration, the attachment position or the replacement position is set as a development cartridge attachment/replacement space that is not the same as the development position.

Figure 5A:
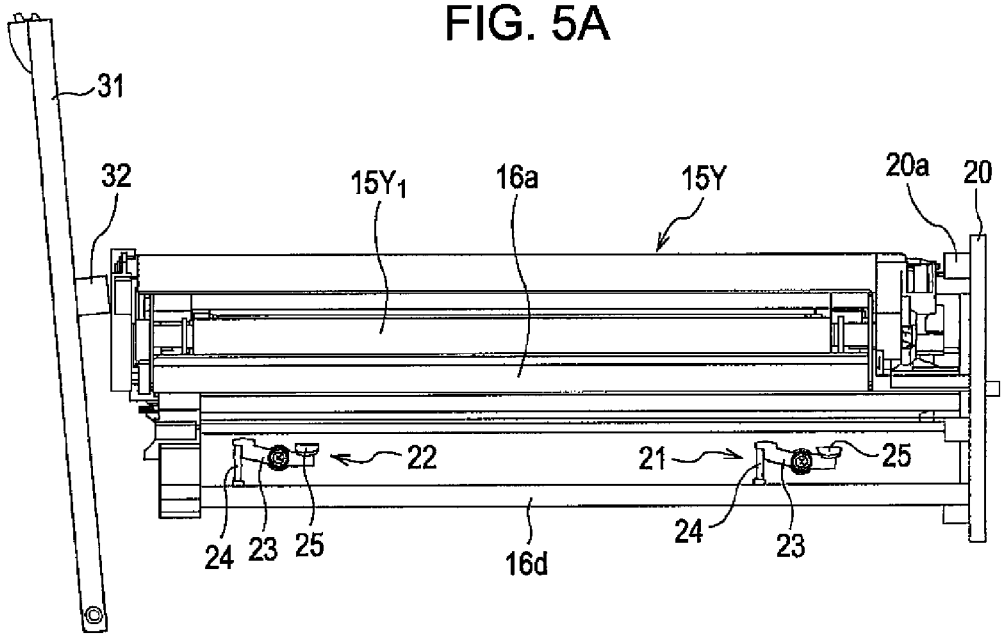
FIGS. 5A and 5B is a set of diagrams that explains the development cartridge pushing operation of a pushing cover.

The apparatus body 30 of the image formation apparatus 1 has an opening (not shown in the drawing) that is provided for replacement of development cartridges at a position corresponding to the replacement position. As illustrated in FIG. 5A, a cover 31 that opens/closes the opening is further provided on the apparatus body 30. The cover 31 is provided on the apparatus body 30 in such a manner that it can move rotationally. A pushing projection 32, which functions to push the attached development cartridge toward the direction of insertion thereof, is provided at a position opposed to the attached development cartridge.

Figure 5B:
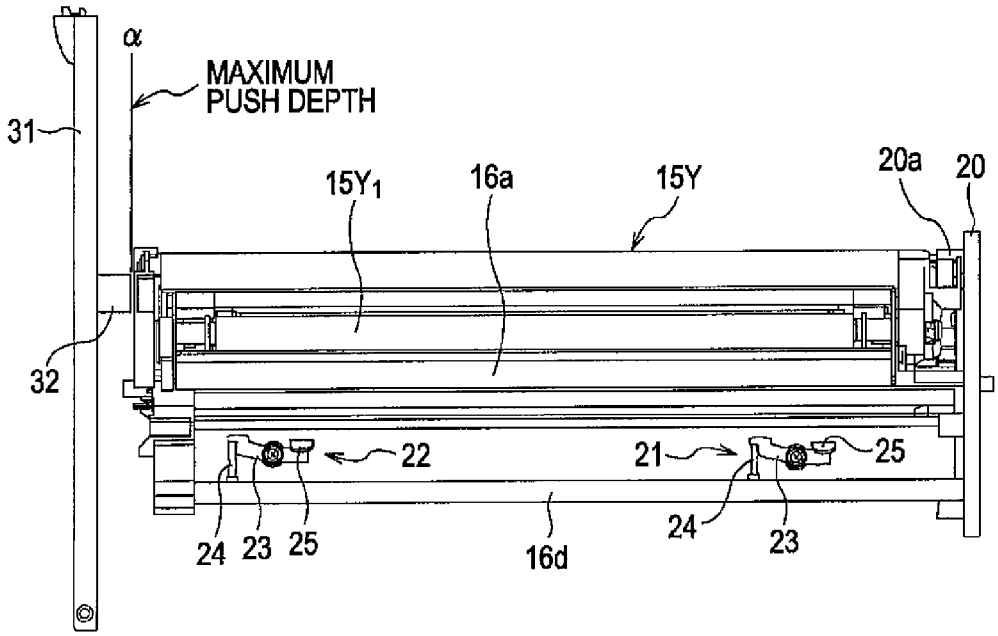

When the cover 31 turns in a closing direction, the front end (right end according to FIG. 5A) of the pushing projection 32 contacts the development cartridge and then pushes the development cartridge inward. In this way, the development cartridge is further inserted into a deeper position in the rotary unit 16. Then, as illustrated in FIG. 5B, the maximum push depth a, which is defined as a depth at which the front end of the pushing projection 32 pushes the development cartridge to its deepest position, is obtained when the cover 31 closes the opening of the apparatus body 30.

Next, in the configuration of the rotary developer 5 according to the present embodiment of the invention described above, an explanation is given of how each of the development cartridges 15Y, 15C, 15M, and 15K is attached in the development cartridge attachment space demarcated by the corresponding adjacent pair of the attachment frames. For the purpose of simplifying description, it is explained how the yellow development cartridge 15Y is attached at the predetermined set position between the corresponding adjacent pair of the attachment frames 16*a* and 16*b*.

In order to attach the yellow development cartridge 15Y to the rotary unit 16, the rotary unit 16 is turned so that the yellow development cartridge 15Y is set at the replacement position, which is a position different from the development position. Next, the user turns the cover 31 to open the opening formed in the apparatus body 30. Subsequently, the user inserts one end portion (i.e., right end portion) of the yellow development cartridge 15Y illustrated in FIG. 4 through the opening while gripping/holding the other end portion (i.e., left end portion) thereof. Then, the user pushes the yellow development cartridge 15Y in the axial direction into the development cartridge attachment space demarcated by the corresponding adjacent pair of the attachment frames 16*a* and 16*b* shown in FIG. 2A.

when the pressed mechanical part 26, which is provided on the yellow development cartridge 15Y, passes through an area in the proximity of the pressing mechanical part 22, which is provided on the rotary unit 16, the pressed mechanical part 26 enters smoothly without being obstructed by the pressing mechanical part 22.

Figure 6A:
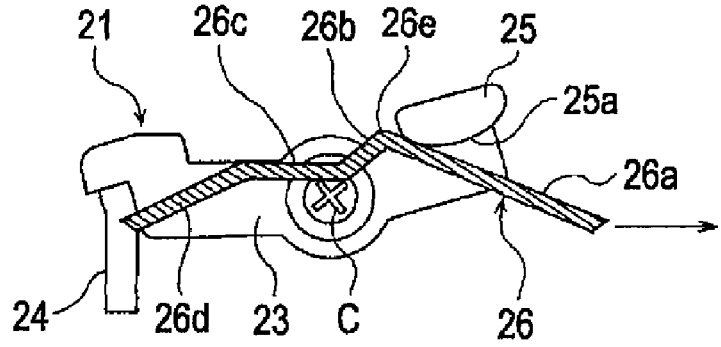
FIGS. 6A-6D is a set of diagrams that explains the operation of a self-attachment-locking mechanism.

As illustrated in FIG. 6A, as the yellow development cartridge 15Y is inserted inward, the gently sloped pressed surface 26*a* of the pressed mechanical part 26 of the yellow development cartridge 15Y becomes in contact with the pressing surface 25*a* of the pressing portion 25 of the pressing mechanical part 21; and at the same time, the gently sloped pressed surface 27*a* of the pressed mechanical part 27 of the yellow development cartridge 15Y becomes in contact with the pressing surface 25*a* of the pressing portion 25 of the pressing mechanical part 22. That is, the pressing surface 25*a* of the pressing portion 25 of each of the pressing mechanical parts 21 and 22 contacts the corresponding pressed mechanical part 26, 27 at one contact point.

As the yellow development cartridge 15Y is further inserted into a deeper position, each of the pressing surfaces 25*a* of the pressing portions 25 moves in a sliding manner while maintaining one-point contact with the corresponding pressed mechanical part 26, 27. When the pressing surfaces 25*a* of the pressing portions 25 of the pressing mechanical parts 21 and 22 move in such a sliding manner, the gently sloped pressed surfaces 26*a* and 27*a* of the pressed mechanical parts 26 and 27 urge the pressing surfaces 25*a* of the pressing portions 25 of the pressing mechanical parts 21 and 22 in an upward direction, respectively. For this reason, each of the levers 23 turns counterclockwise against the urging force (i.e., decompression force) of the corresponding compression spring 24 as illustrated in FIG. 6A. In response to the turn of each of the levers 23, each of the pressing surfaces 25*a* of the pressing portions 25 applies a pressing force to the corresponding gently sloped pressed surfaces 26*a* and 27*a* because of the decompression force of the corresponding compression spring 24. Then, the axial direction component of the pressing force applied by each of the pressing portions 25 is exerted toward the reverse direction of the insertion of the yellow development cartridge 15Y, that is, the direction of removal/detachment thereof. However, since each of the compression springs 24 is not so much compressed, the decompression force thereof is relatively small. In addition, since the inclination of each of the gently sloped pressed surfaces 26*a* and 27*a* is relatively small, the axial direction component of the pressing force is small. Therefore, the user can insert the yellow development cartridge 15Y quite smoothly.

Figure 6B:
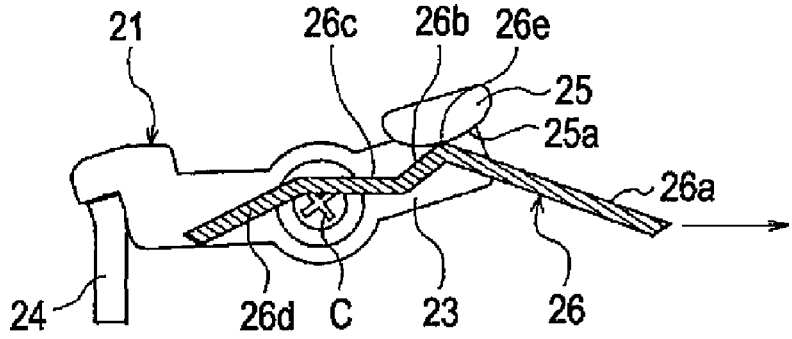

As the yellow development cartridge 15Y is further inserted into a deeper position, as illustrated in FIG. 6B, the pressing surfaces 25*a* of the pressing mechanical parts 21 and 22 become in contact with the apex portions 26*e* and 27*e* of the pressed mechanical parts 26 and 27, respectively. In such a state, each of the compression springs 24 of the pressing mechanical parts 21 and 22 is compressed at its maximum compression level. Therefore, the decompression force thereof is largest in this state.

Figure 7A:
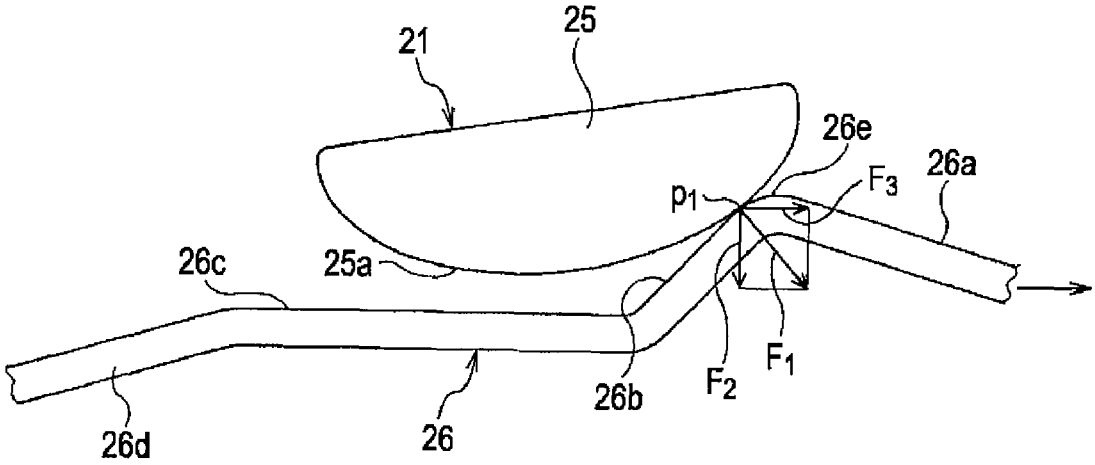
FIGS. 7A and 7B is a set of diagrams that explains the exertion of a pressing force as well as the components thereof during the operation of the self-attachment-locking mechanism.

As the yellow development cartridge 15Y is further moved into a deeper position, the yellow development cartridge 15Y reaches a state at which it is inserted in the rotary unit 16 by a predetermined insertion amount. In such a state, as illustrated in FIG. 7A, each of the pressing surfaces 25*a* of the pressing mechanical parts 21 and 22 becomes in contact with the corresponding steeply sloped pressed surfaces 26*b* and 27*b* of the pressed mechanical parts 26 and 27 at a contact position $p_1$. At this time, each of the pressing surfaces 25*a* of the pressing mechanical portions 25 presses the corresponding steeply sloped pressed surfaces 26*b* and 27*b* with a comparatively large pressing force $F_1$ due to the increased decompression force of the corresponding compression spring 24.

Accordingly, the perpendicular direction component $F_2$ of the pressing force $F_1$, which is orthogonal to the axial (i.e., insertion) direction component thereof ($F_3$), is exerted to apply pre-pressure onto the yellow development cartridge 15Y toward the photosensitive member 2. On the other hand, the axial direction component $F_3$ of the pressing force $F_1$ is exerted in such a manner that the yellow development cartridge 15Y is pressed toward the direction of insertion thereof. Accordingly, the pressing force of each of the pressing portions 25 of the pressing mechanical parts 21 and 22 (the axial direction component $F_3$ thereof) causes the yellow development cartridge 15Y to move by itself in the direction of insertion thereof without requiring the user to apply an insertion force thereto. As a result thereof, as illustrated in FIG. 6C, the yellow development cartridge 15Y is automatically attached at its set position.

As described above, the yellow development cartridge 15Y is automatically attached at its set position of the rotary unit 16 just by inserting it therein by the predetermined insertion amount.

At this time, the joint pin 28, which is one of the pair of coupling pins provided on the yellow development cartridge 15Y, fits into the joint hole 16*b*$_1$, of the attachment frame 16*b*, whereas the joint pin 29, the other of the pair, fits into the joint hole 16*a*$_2$ of the attachment frame 16*a*. By this means, the yellow development cartridge 15Y is fastened to the rotary unit 16 and stabilized in the rotational direction thereof. In addition, the positional determination pin of the yellow development cartridge 15Y fits into the positional determination hole part 20*a* provided on the disc member 20. By this means, the position of the yellow development cartridge 15Y is fixed to make it stabilized in the rotational direction thereof.

Figure 6C:
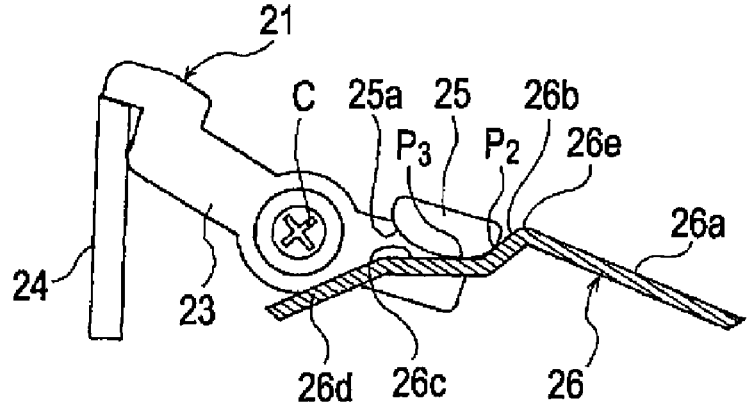
Figure 7B:
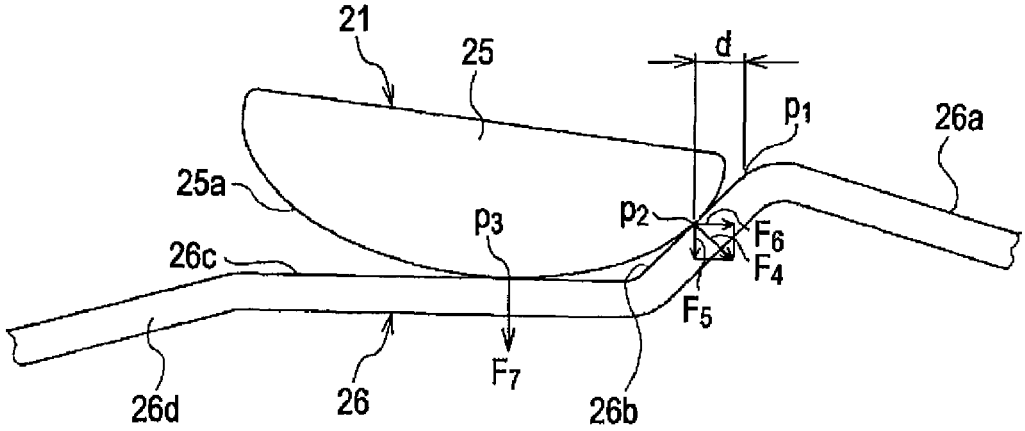

As illustrated in FIGS. 6C and 7B, when the yellow development cartridge 15Y is attached at the set position of the rotary unit 16, each of the pressing surfaces 25*a* of the pressing portions 25 is in contact with both of the corresponding steeply sloped pressed surface 26*b*, 27*b* and the corresponding level pressed surface 26*c*, 27*c*. In other words, when the yellow development cartridge 15Y is set at the non-development position, each of the pressing surfaces 25*a* of the pressing portions 25 is in contact with the corresponding pressed mechanical part 26, 27 at two contact points $p_2$ and $p_3$. In such a state, it is configured so that the contact position $p_2$ between each of the pressing surfaces 25*a* and the corresponding steeply sloped pressed surface 26*b* or 27*b* is either exactly or substantially in alignment with the rotational center C of the corresponding lever 23 when viewed along the direction of insertion of the yellow development cartridge 15Y.

In this state, as illustrated in FIG. 7B, each of the pressing surfaces 25*a* of the pressing portions 25 applies a pressing force $F_4$ to the corresponding steeply sloped pressed surface 26*b* or 27*b* at the contact position $p_2$ because of the decompression force of the corresponding compression spring 24. The perpendicular direction component $F_5$ of the pressing force $F_4$, which is orthogonal to the axial (i.e., insertion/removal) direction component thereof ($F_6$), is exerted to apply pressure onto each of the pressed mechanical parts 26 and 27 in the direction orthogonal to the insertion/removal direction of the yellow development cartridge 15Y. The pair of the pressing mechanical parts 21 and 22 and the counterpart pair of the pressed mechanical parts 26 and 27 constitute pre-pressure applying mechanisms each of which presses the gap-forming rollers 15Y$_4$ of the yellow development cartridge 15Y toward the center of the photosensitive member 2 when the yellow development cartridge 15Y is set at the development position.

In addition to the above, the insertion/removal direction component $F_6$ of the pressing force $F_4$ works to press each of the pressed mechanical parts 26 and 27 in the insertion direction of the yellow development cartridge 15Y. Even when the axial direction component $F_6$ of the pressing force $F_4$ acts to press each of the pressed mechanical parts 26 and 27 in the insertion direction of the yellow development cartridge 15Y, since the yellow development cartridge 15Y is locked in the rotary unit 16 in the insertion direction thereof, the locked yellow development cartridge 15Y never moves in the insertion direction thereof. With such a structure, even when a moving force is exerted on the yellow development cartridge 15Y in the removal/detachment direction thereof due to the rotation of the rotary unit or any other similar reason, it is possible to prevent the yellow development cartridge 15Y from being removed/detached because each of the pressing surfaces 25*a* of the pressing portions 25 is in contact with, and thus holds, the corresponding steeply sloped pressed surface 26*b* or 27*b*. Herein, the pressing force $F_4$ that is applied by each of the pressing surfaces 25*a* of the pressing portions 25 to the corresponding steeply sloped pressed surface 26*b* or 27*b* is relatively small.

In addition to the above, each of the pressing surfaces 25*a* of the pressing mechanical portions 25 presses the corresponding level pressed surface 26*c*, 27*c* with a pressing force $F_7$ at the contact position $p_3$ in the direction orthogonal to the insertion/removal direction of the yellow development cartridge 15Y due to the decompression force of the corresponding compression spring 24. Thus, the yellow development cartridge 15Y is locked both in the insertion/removal direction and the direction orthogonal to the insertion/removal direction.

As described above, the yellow development cartridge 15Y is automatically inserted thanks to the axial direction component of the pressing force applied by each of the pressing portions 25 so that it is attached at its set position by itself in a reliable manner without requiring a user to apply an insertion force thereto. Such an automatic insertion/attachment is carried out when the yellow development cartridge 15Y is set at the replacement position, which is a position different from the development position, and then inserted into the development cartridge attachment space demarcated by the adjacent pair of the attachment frames 16*a* and 16*b*. Herein, it should be particularly noted that the user has only to insert the yellow development cartridge 15Y by the predetermined insertion amount, which does not make the yellow development cartridge 15Y reach the predetermined set position, in order to activate such an automatic insertion/attachment function. In addition, the yellow development cartridge 15Y is "self-locked" both in the insertion/removal direction and the direction orthogonal to the insertion/removal direction.

The lever 23, the compression spring 24, the pressing surface 25*a* of the pressing portion 25, the steeply sloped pressed surface 26*b* or 27*b*, and the level pressed surface 26*c* or 27*c* constitute the self-attachment-locking mechanism of (i.e., that functions for) the yellow development cartridge 15Y. The predetermined insertion amount at which the self-attachment-locking mechanism of the yellow development cartridge 15Y activates (i.e., starts to operate) is set at an amount that is necessary and sufficient for causing a transition of the contact position/point from between each of the pressing surfaces 25*a* of the pressing portions 25 and the corresponding gently sloped pressed surface 26*a* or 27*a* to between each of the pressing surfaces 25*a* of the pressing portions 25 and the corresponding steeply sloped pressed surface 26*b* or 27*b*.

The amount of movement "d" (illustrated in FIG. 7B) from the start point at which the self-attachment-locking mechanism of the yellow development cartridge 15Y initiates its automatic insertion operation to the end point at which the yellow development cartridge 15Y is self-locked is given as the insertion direction component of the inclined distance between the contact position $p_1$ and the contact position $p_2$ on the steeply sloped pressed surface 26*b* or 27*b*.

It should be noted that a force that is exerted during the insertion of the yellow development cartridge 15Y reverses its direction suddenly when the contact position/point between each of the pressing surfaces 25*a* and the corresponding pressed mechanical part 26*a*, 27 transitions from the gently sloped pressed surface 26*a*, 27*a* to the steeply sloped pressed surface 26*b*, 27*b* via the apex portion 26*e*, 27*e*. Therefore, as a further advantage, such a structure provides a user with a tactile feel at the instant of the transition. Thus, the user can perceive the activation/initiation of the automatic insertion function/operation performed by the self-attachment-locking mechanism of the yellow development cartridge 15Y on the basis of the tactile feel. Finally, the user turns the cover 31 back to close the opening. When the cover 31 is in a closed state, the pushing projection 32 is not in contact with the rear/proximal end viewed in the direction of insertion of the yellow development cartridge 15Y.

Next, in order to perform development by means of the yellow toner, the rotary unit 16 is turned in the same manner as mentioned above to move the yellow development cartridge 15Y, which is currently attached at the set position, to the development position. During the rotation of the rotary unit 16, since the yellow development cartridge 15Y is locked at the above-mentioned two contact positions $p_2$ and $p_3$ by the self-attachment-locking mechanism, the yellow development cartridge 15Y is carried in a stable manner without any significant shake and/or rattle both in the insertion/removal direction and the direction orthogonal to the insertion/removal direction.

Figure 6D:
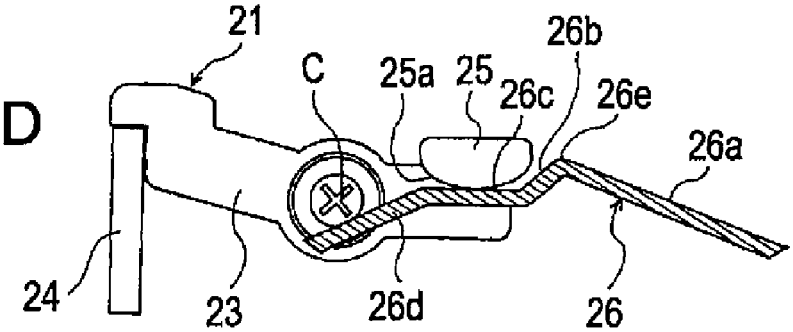

When the yellow development cartridge 15Y is set at the development position as shown in FIGS. 1 and 3, the pair of the gap-forming rollers $\mathbf{15}Y_4$ become in contact with the photosensitive member 2. Accordingly, as illustrated in FIG. 6D, the yellow development cartridge 15Y is slightly pressed back in the direction orthogonal to the insertion direction thereof (i.e., in the upward direction according to FIG. 6D) against the decompression force of the compression springs 24. As the yellow development cartridge 15Y is pressed back slightly, each of the levers 23 turns counterclockwise by a small amount, that is, from the position shown by FIG. 6C to the position shown by FIG. 6D.

As illustrated in FIG. 5C, since the contact position $p_2$ between each of the pressing surfaces 25*a* and the corresponding steeply sloped pressed surface 26*b*, 27*b* is either exactly or substantially in alignment with the rotational center C of the corresponding lever 23 when viewed along the direction of insertion of the yellow development cartridge 15Y, even a small amount of counterclockwise turn of each of the levers 23 causes the corresponding pressing surface 25*a* to move slightly away from the corresponding steeply sloped pressed surface 26*b*, 27*b*. For this reason, when the yellow development cartridge 15Y is set at the development position, each of the pressing surfaces 25*a* of the pressing portions 25 is in contact with the corresponding pressed mechanical part 26, 27 at only one contact point.

As described above, when the yellow development cartridge 15Y is set at the development position, it is susceptible to shake and/or rattle in the insertion/removal direction thereof because each of the pressing surfaces 25*a* of the pressing portions 25 is in contact with the corresponding pressed mechanical part 26, 27 at only one contact point. Notwithstanding such susceptibility, since both of the development driving gear 34 and the development input gear $\mathbf{15}Y_5$ are configured as helical gears, the helical-gear configuration provides a momentum to the yellow development cartridge 15Y along the axial direction, that is, in the insertion direction thereof when the yellow development roller $\mathbf{15}Y_1$ of the yellow development cartridge 15Y rotates at the development position. Thanks to the above-described momentum, even when each of the pressing surfaces 25*a* of the pressing portions 25 becomes in contact with the corresponding pressed mechanical part 26, 27 at only one contact point as the yellow development cartridge 15Y is set at the development position, it is possible to prevent the occurrence of any shake and/or rattle in the insertion/removal direction thereof as long as the yellow development roller $\mathbf{15}Y_1$ of the yellow development cartridge 15Y rotates thereat. Any redundant explanation of the attachment of other remaining development cartridges 15C, 15M, and 15K to the predetermined set positions is omitted herein because it is done in the same manner as done for the yellow development cartridge 15Y.

While referring to FIG. 5A, it is assumed that a user turns the cover 31 clockwise in order to close the opening, although the yellow development cartridge 15Y is not inserted sufficiently, meaning that the depth of insertion falls short of the predetermined insertion amount. If the user turns the cover 31 clockwise under such a condition, the pushing projection 32 becomes in contact with the rear/proximal end (i.e., left end according to FIG. 5A) of the yellow development cartridge 15Y viewed in the direction of insertion thereof. Then, if the user continues to turn the cover 31 further in its closing direction, the pushing projection 32 pushes the yellow development cartridge 15Y inward. As a result thereof, the yellow development cartridge 15Y moves in the direction of insertion thereof.

Accordingly, before the pushing projection 32 reaches the maximum push depth a shown in FIG. 5B, the pressing surfaces 25*a* of the pressing mechanical parts 21 and 22 become in contact with the apex portions 26*e* and 27*e* of the pressed mechanical parts 26 and 27, respectively, as illustrated in FIG. 6B. In such a state, as has already been described, each of the compression springs 24 of the pressing mechanical parts 21 and 22 is compressed at its maximum compression level. Therefore, the decompression force thereof is largest in this state.

Then, when the user turns the cover 31 to close the opening of the apparatus body completely, the pushing projection 32 reaches its maximum push depth a shown in FIG. 5B. At the maximum push depth a of the pushing projection 32, the yellow development cartridge 15Y is inserted in the rotary unit 16 by the predetermined insertion amount. In such a state, as illustrated in FIG. 7A, each of the pressing surfaces 25*a* of the pressing mechanical parts 21 and 22 becomes in contact with the corresponding steeply sloped pressed surfaces 26*b* and 27*b* of the pressed mechanical parts 26 and 27 at the contact position $p_1$. At this time, each of the pressing surfaces 25*a* of the pressing mechanical portions 25 presses the corresponding steeply sloped pressed surfaces 26*b* and 27*b* with a comparatively large pressing force $F_1$ due to the increased decompression force of the corresponding compression spring 24. Thereafter, in the same manner as has already been described above, the yellow development cartridge 15Y is attached at the set position automatically, and self-locked at the set position.

With the configuration of the rotary developer 5 according to the present embodiment of the invention, thanks to the self-attachment-locking mechanism, each of the development cartridges 15Y, 15C, 15N, and 15K is automatically and thus easily attached at the predetermined set position of the rotary unit 16 just by inserting it therein by the predetermined insertion amount, which is insufficient for causing the development cartridges 15Y, 15C, 15M, and 15K to reach the above-mentioned predetermined set position. In addition thereto, each of the development cartridges 15Y, 15C, 15M, and 15K is automatically and thus easily self-locked at the above-mentioned predetermined set position of the rotary unit 16 just by doing the same.

Therefore, even if a user inadvertently fails to insert the development cartridges 15Y, 15C, 15M, and 15K properly, which means that the depth of the inserted development cartridges 15Y, 15C, 15M, and 15K falls short of the predetermined set position in the rotary unit 16, it is still possible to attach and lock the development cartridges 15Y, 15C, 15M, and 15K at the above-mentioned predetermined set position without fault. In such a self-locking operation, the self-attachment-locking mechanism ensures that each of the development cartridges 15Y, 15C, 15M, and 15K is locked both in the insertion/removal direction and the direction orthogonal to the insertion/removal direction thereof.

Since each of the development cartridges 15Y, 15C, 15M, and 15K is locked in the insertion/removal direction thereof securely, it is possible to prevent any "slip out" (i.e., unintended removal/detachment) and undesirable shake/rattle thereof in a reliable manner.

Since the lever 23, the compression spring 24, the pressing surface 25*a* of the pressing portion 25, the steeply sloped pressed surface 26*b* or 27*b*, and the level pressed surface 26*c* or 27*c* constitute the self-attachment-locking mechanism of each of the development cartridges 15Y, 15C, 15M, and 15K, it is possible to attach and lock the development cartridges 15Y, 15C, 15M, and 15K at the above-mentioned predetermined set position in a reliable manner while simplifying the structure of the self-attachment-locking mechanism and further simplifying the attachment operation of the development cartridges 15Y, 15C, 15M, and 15K.

In particular, when each of the development cartridges 15Y, 15C, 15M, and 15K is set at the non-development position, each of the pressing surfaces 25*a* of the pressing portions 25 is in contact with the corresponding steeply sloped pressed surface 26*b*, 27*b* and the corresponding level pressed surface 26*c*, 27*c* of the corresponding pressed mechanical part 26, 27 at two contact points. Therefore, the self-attachment-locking mechanism ensures that each of the development cartridges 15Y, 15C, 15M, and 15K is locked both in the insertion/removal direction and the direction orthogonal to the insertion/removal direction thereof just with a simple structure. By this means, it is possible to prevent any unintended removal/detachment of the development cartridges 15Y, 15C, 15M, and 15K during rotation of the rotary unit 16.

The integrated pressed surface where each of the pressing surfaces 25*a* of the pressing portions 25 contacts is constituted by the gently sloped pressed surface 26*a*, 27*a* and the steeply sloped pressed surface 26*b*, 27*b* having, just for the purpose of descriptive and illustrative explanation, an asymmetrical boomerang shape having a longer right wing (for example, refer to the drawings). Therefore, a force that is exerted during the insertion of each of the development cartridges 15Y, 15C, 15M, and 15K, that is, the axial direction component of the pressing force applied by each of the pressing portions 25 onto the gently sloped pressed surface 26*a*, 27*a*/the steeply sloped pressed surface 26*b*, 27*b*, reverses its direction suddenly when the contact position/point between each of the pressing surfaces 25*a* and the corresponding pressed mechanical part 26, 27 transitions from the gently sloped pressed surface 26*a*, 27*a* to the steeply sloped pressed surface 26*b*, 27*b*. Since such a sudden change in the direction of the force gives a tactile feel to the user, they can perceive the activation/initiation of the automatic insertion function/operation performed by the self-attachment-locking mechanism of each of the development cartridges 15Y, 15C, 15M, and 15K.

In the configuration of the rotary developer 5 according to the present embodiment of the invention, the pressing mechanical parts 21, 22 and the pressed mechanical part 26, 27 that function, in combination with each other, to apply pre-pressure onto each of the development cartridges 15Y, 15C, 15M, and 15K toward the photosensitive member 2 are used as constituent elements of the self-attachment-locking mechanism. Since these components double as the pre-pressure applying mechanism and constituent elements of the self-attachment-locking mechanism, it is possible to avoid an increase in parts count (i.e., the number of parts) and further possible to reduce cost.

Moreover, even if a user closes the cover 31 when the development cartridge 15Y, 15C, 15M, or 15K is not inserted sufficiently, meaning that the depth of insertion thereof falls short of the predetermined insertion amount, the closing operation of the cover 31 ensures that the development cartridge 15Y, 15C, 15M, or 15K is attached at its set position. Such a structure further simplifies the attachment operation of the development cartridges 15Y, 15C, 15M, and 15K.

When the cover 31 is closed to push the development cartridge 15Y, 15C, 15M, or 15K to its deepest position, the self-attachment-locking mechanism activates for the attachment and locking of the development cartridge 15Y, 15C, 15M, or 15K. Thus, it is possible to attach and lock the development cartridge 15Y, 15C, 15M, or 15K at the above-mentioned predetermined set position in a reliable manner.

When the development cartridge is set at the development position, each of the pressing surfaces of the pressing portions is in contact with the corresponding level pressed surface of the pressed mechanical part at only one contact point. However, since both of the development driving gear and the development input gear are configured as helical gears, the helical-gear configuration provides a momentum to the development cartridge along the axial direction, that is, in the insertion direction thereof when the development cartridge is driven at the development position thereof. Therefore, even when the development cartridge is set at the development position so that each of the pressing surfaces of the pressing portions is in contact with the corresponding level pressed surface of the pressed mechanical part at only one contact point, it is still possible to lock the development cartridge that is carried from the attached set position both in the insertion/removal direction and the direction orthogonal to the insertion/removal direction thereof just with a simple structure.

In the exemplary embodiment of the invention described above, a pair of the pressing mechanical parts 21 and 22 is provided on the rotary unit 16, whereas a pair of the pressed mechanical parts 26 and 27 is provided on the development cartridge. Notwithstanding the foregoing, the invention is in no case limited to such an example. That is, the invention may be modified such that the pair of the pressing mechanical parts 21 and 22 is provided on the development cartridge, whereas the pair of the pressed mechanical parts 26 and 27 is provided on the rotary unit 16.

In the configuration of the exemplary embodiment of the invention described above, the attachment of a development cartridge is partly performed by the turn of the cover 31. However, it is possible for a user to attach the development cartridge by themselves without the help of the cover 31. In such an alternative configuration, as long as the user inserts the development cartridge to the predetermined point (i.e., depth) where the self-attachment-locking mechanism activates, the development cartridge is automatically attached at its set position by means of the activation of the self-attachment-locking mechanism; and in addition thereto, the development cartridge is self-locked both in the insertion/removal direction and the direction orthogonal to the insertion/removal direction thereof. Accordingly, in such an alternative configuration, the pushing projection 32 provided on the cover 31 according to the exemplary embodiment of the invention described above is omitted.

It should be noted that the pressing mechanical parts 21 and 22 do not always have to be used as components of the self-attachment-locking mechanism. For example, other dedicated self-attachment-locking mechanism may be provided. Notwithstanding the foregoing, it is preferable to use the pressing mechanical parts 21 and 22 as components of the self-attachment-locking mechanism because of the operation/working effects described above.

What is claimed is:

1. A rotary developer comprising:

a rotary unit that accommodates a plurality of development cartridges each of which has at least a development roller, each of the plurality of development cartridges being inserted into the rotary unit in the axial direction thereof so as to be attached at a respective predetermined set position of the rotary unit by a self-attachment-locking mechanism, the rotary unit moving each of the plurality of development cartridges between a development position and a non-development position in a selective manner;

wherein the self-attachment-locking mechanism starts to operate when one of the plurality of development cartridges is inserted into the rotary unit by a predetermined insertion amount, the self-attachment-locking mechanism further positionally translated the one of the plurality of development cartridges beyond said predetermined insertion amount and to said predetermined set position, and the self-attachment-locking mechanism operates to automatically attach and self-lock the one of the plurality of development cartridges at the predetermined set position; and a pre-pressure applying mechanism that applies pre-pressure onto the development cartridge attached at the predetermined set position toward an image carrier, wherein the self-attachment-locking mechanism is constituted by the pre-pressure applying mechanism, wherein the pre-pressure applying mechanism is made up of a pressing member that is provided on either one of the rotary unit and the development cartridge and a pressed member that is provided on the other of the rotary unit and the development cartridge, the pressing member applying a pressing force onto the development cartridge attached at the predetermined set position toward the image carrier, the pressed member being pressed by the pressing member;

the pressing member has a rotatable lever, a pressing portion that is provided on one end of the lever so as to press the pressed member, and an urging unit that is provided on the other end of the lever and applies an urging force to the lever in a direction in which the pressing portion presses the pressed member;

the pressed member has a pressed surface with which the pressing portion becomes in contact at the time of insertion of the development cartridge in the axial direction;

the pressed surface has a gently sloped pressed surface having a relatively small inclination and a steeply sloped pressed surface having a relatively large inclination in comparison with that of the gently sloped pressed surface, the gently sloped pressed surface becoming in contact with the pressing portion earlier than any other surface at the time of insertion of the development cartridge in the axial direction, and after becoming in contact therewith, the gently sloped pressed surface causing the lever to rotate in a direction that is against the urging force of the urging unit as the development cartridge is inserted, the steeply sloped pressed surface extending from the gently sloped pressed surface, the inclination of the steeply sloped pressed surface being opposite to that of the gently sloped pressed surface, the gently sloped pressed surface and the steeply sloped pressed surface forming an asymmetrical boomerang shape; and the predetermined insertion amount of the development cartridge is set at an amount that causes a transition of a contact position at which the pressing portion is in contact with the pressed surface from the gently sloped pressed surface to the steeply sloped pressed surface.

2. The rotary developer according to claim 1, wherein the pressed surface further has a level pressed surface that extends from the steeply sloped pressed surface and is parallel to the direction of insertion of the development cartridge, and when the development cartridge is attached at the predetermined set position of the rotary unit that is not the development position, the pressing portion is in contact with the steeply sloped pressed surface and the level pressed surface at two contact points.

3. An image formation apparatus comprising:

an apparatus body;

an image carrier that is provided in the apparatus body and carries an electrostatic latent image and a toner image; and a rotary developer that is provided in the apparatus body and develops the electrostatic latent image carried on the image carrier so as to form the toner image, wherein the above-mentioned rotary developer is constituted by the rotary developer according to claim 2;

the development cartridge is provided with a development input gear that drives the development roller, whereas a development driving gear that engages with the development input gear at the development position of the development cartridge is provided in the apparatus body;

both of the development input gear and the development driving gear are configured as helical gears; and the pressing portion is in contact with the level pressed surface at one contact point when the development cartridge is set at the development position, and the helical gears provide a momentum to the development cartridge along the axial direction of insertion thereof when the development input gear and the development driving gear rotate.

4. The image formation apparatus according to claim 3, wherein the apparatus body has an opening through which the development cartridge can be inserted, the opening being formed at a position corresponding to a replacement position;

the apparatus body is provided with a cover that can turn to open and close the opening, the cover having a pushing projection that pushes the development cartridge inserted in the rotary unit toward the predetermined set position; and the maximum push depth at which the pushing projection pushes the development cartridge to the deepest position thereof is set at the predetermined amount of insertion of the development cartridge obtained when the cover closes the opening.

* * * * *